US006111550A

United States Patent [19]

Miller et al.

[11] Patent Number: 6,111,550

[45] Date of Patent: Aug. 29, 2000

[54] HIGH GAIN COMPACT SCANNING PERSONAL COMMUNICATION SYSTEM ARRAY

[75] Inventors: Darrell W. Miller, Allen; Joseph E. Wheeler, III, Plano; Paul C. Gilliland; Leslie D. Clements, both of Allen, all of Tex.

[73] Assignee: Texas Instruments Incorporated, Dallas, Tex.

[21] Appl. No.: 08/938,170

[22] Filed: Sep. 26, 1997

[51] Int. Cl.[7] ..... H01Q 1/42

[52] U.S. Cl. ..... 343/872; 343/826

[58] Field of Search ..... 343/705, 826, 343/833, 834, 872, 835; H01Q 1/42

[56] References Cited

U.S. PATENT DOCUMENTS

| | | | |
|---|---|---|---|
| 2,105,569 | 1/1938 | White et al. | 343/826 |
| 2,452,073 | 10/1948 | Schivley et al. | 343/705 |
| 3,136,996 | 6/1964 | Parker | 343/761 |
| 5,206,656 | 4/1993 | Hannan | 343/705 |
| 5,638,081 | 6/1997 | MacDonald et al. | 343/890 |
| 5,654,722 | 8/1997 | Lundback et al. | 343/890 |
| 5,896,112 | 4/1999 | Bickford et al. | 343/872 |

*Primary Examiner*—Michael C. Wimer

*Attorney, Agent, or Firm*—Wade James Brady, III; Frederick J. Telecky, Jr.

[57] ABSTRACT

An endfire monopole array in a low cross section, low profile package with the area used being vertical or tube-like. The array is aerodynamically shaped on one or more sides in order to minimize wind resistance. The antenna array includes an RF transparent housing having a tapered end portion which is substantially "V" shaped, a first plurality of parallel endfire monopole antenna elements secured to a stripline or microstrip within the housing, each antenna element thereof extending in a first direction and a second plurality of parallel endfire monopole antenna elements secured to a stripline or microstrip within the housing, each antenna elements of the second plurality extending in the first direction, the first plurality being spaced from the second plurality in the first direction. An energy feeding structure is coupled to the antenna elements, with a dielectric layer disposed over that structure and a ground plane disposed over the dielectric layer. A line bisecting the "V" is normal to the first direction.

16 Claims, 1 Drawing Sheet

HIGH GAIN COMPACT SCANNING PERSONAL COMMUNICATION SYSTEM ARRAY

BACKGROUND OF THE INVENTION

1. Field of the Invention

This invention relates to a scanning array for use in conjunction with personal communication systems (PCS) and, more specifically, to a compact antenna for use in conjunction with mobile communication systems.

2. Brief Description of the Prior Art

In the field of mobile communication, such as, for example, cellular telephone systems which operate generally in the 850 MHz and 1900 MHz frequency regions, it is necessary to provide a multiplicity of antennas throughout the area covered by the system so that a user of the system has access thereto at all locations within the covered area. The quality of communication depends in part upon the gain of the antenna arrays and the number and proximity of antenna arrays to each other within the covered area. Gains in excess of 21 dBli are consistently requested by users. Improved gain is constantly being sought, especially in the 1900 MHz frequency region. The prior art has generally used patch and dipole antennas in a flat or "billboard" style with the "billboard" plane being vertical for this purpose with the antenna elements extending outwardly horizontally or parallel to the ground to provide the proper pattern for these types of antenna elements. Such antenna arrays generally have dimensions of about 3 feet by about 5 feet or more to obtain the required gain.

Two methods of improving access to the system have been to increase the number of antenna arrays in the covered area and/or to increase the gain of the system antenna arrays, this being accomplished by increasing the surface areas of the individual antenna arrays. While an increase in antenna array area does and has improved access to the mobile communication systems, such larger area antenna arrays become increasingly unsightly with increase in size, especially for tower top applications in urban environments where their use can also be subject to adverse zoning requirements. Such larger area antennas also become more subject to wind load effects with increase in exposed area. Such wind load effects also have a deleterious effect on the electrical properties of the antenna. It is therefore apparent that an improved type of antenna system which eliminates or at least minimizes the above noted problems of the prior art is highly desirable.

SUMMARY OF THE INVENTION

In accordance with the present invention, the above described problems of the prior art are minimized. This is accomplished by providing an antenna array for use in conjunction with PCS systems and the like which has a low profile and smaller cross sectional area as compared with the prior art "billboard" type antenna of the same gain and appears in shape closer to that of a light fixture to provide improved aesthetics.

Briefly, the antenna array in accordance with the present invention utilizes a plurality of endf ire monopole antenna elements which transmit energy in a direction normal to their major axis. The antenna array has a low cross section, low profile package with the area used being vertical or tube-like as opposed to the billboard shape and patch or dipole arrays of the prior art. The monopole antenna elements are stacked in plural planes above and below each other rather then being all in one plane as in the prior art and preferably extend upwardly and/or downwardly in a direction generally normal to the ground though the antenna array will operate, but less efficiently, as long as a major component of the major axes of the antenna elements is normal to the ground. In addition, the radome housing the array is aerodynamically shaped on one or more sides in order to minimize wind resistance.

The antenna array includes an RF transparent housing having a tapered end portion which is preferably substantially "V" shaped, a first plurality of parallel endfire monopole antenna elements preferably secured to a stripline or microstrip within the housing, each antenna element thereof extending in a first direction and a second plurality of parallel endfire monopole antenna elements secured to a stripline or microstrip within the housing, each antenna elements of the second plurality extending in the first direction, the first plurality being spaced from the second plurality in the first direction. An energy feeding structure in the form of the stripline or microstrip is coupled to the antenna elements, with a dielectric layer disposed over that feeding structure and a ground plane disposed over the dielectric layer. A tapered end portion preferably is disposed so that a line bisecting the "V" is normal to the first direction.

DESCRIPTION OF THE PREFERRED EMBODIMENT

Figure 1:
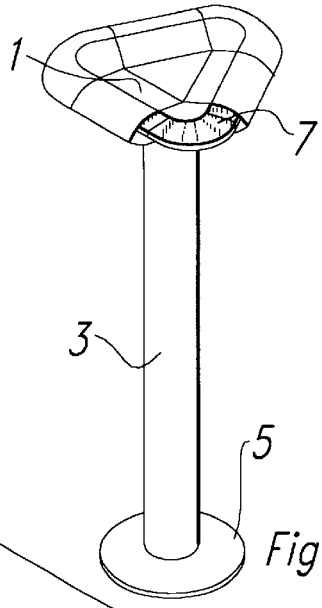
FIG. 1 is a schematic diagram of the antenna array of the present invention operationally positioned.

Referring first to FIG. 1, there is shown a typical antenna array in accordance with the present invention. The antenna array 1 is disposed on a pole 3 which is anchored in the ground 5. The antenna 1 is coupled to a communication system in standard manner which forms no part of this invention and will not be discussed herein. The antenna 1 includes a plurality of vertically extending dipole antenna elements 7 which will be discussed in more detail hereinbelow.

Figure 2A:
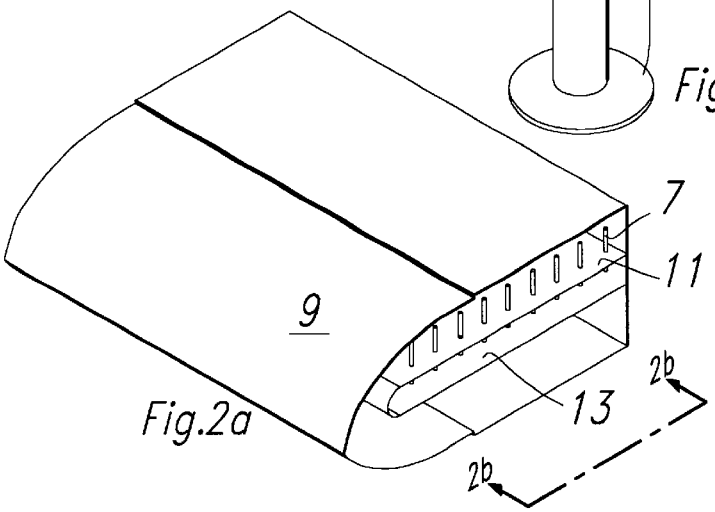
FIG. 2*a* is a perspective view of an antenna array in accordance with the present invention.
Figure 2B:
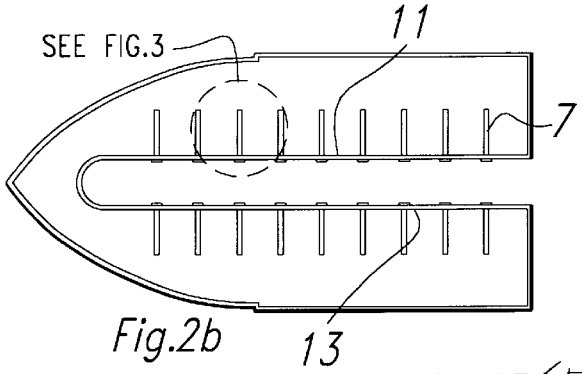
FIG. 2*b* is a cross sectional view taken along the line 2*b*—2*b* of FIG. 2*a*.

The antenna 1 is shown in greater detail in FIGS. 2a and 2b and includes a radome portion 9 of a dielectric material which is transparent to RF in the range of interest, such as, for example, fiberglass, and secured to a pair of multilayered regions 11 and 13 which retain the dipole antenna elements 7. The frequency range for which the dipole antenna elements 7 is designed is determined by the height thereof as is well known. The radome portion 9 and multilayered portions 11 are in the form of a "V" with the dipole antenna elements 7 extending vertically upward from the multilayered region 11 and extending vertically downward from the multilayered region 13. The radome portion is aerodynamically shaped with the curved or bottom portion of the "V" preferably, but not necessarily, being essentially pointed to minimize wind resistance. It should be understood that an aerodynamically shaped radome portion can be disposed on some or all edges to minimize wind resistance in all directions.

Figure 3:
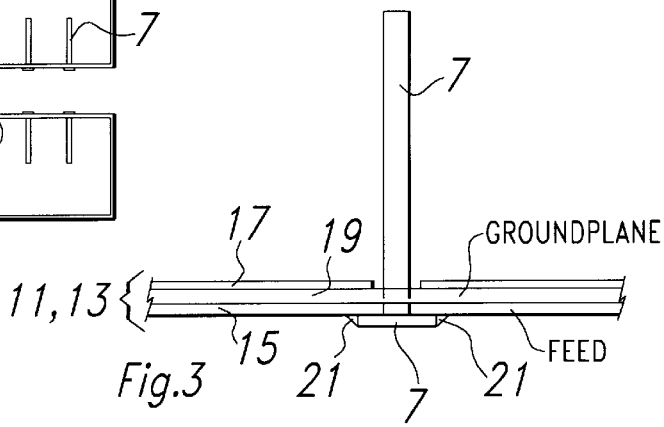
FIG. 3 is a cross sectional view taken along the line 3—3 of FIG. 2*b*.

The multilayered regions 11 and 13 are shown in part in greater detail in FIG. 3 wherein each multilayered region is shown as having a first feed layer 15 formed of an electrical conductor, preferably copper, the layer 15 preferably being a microstrip or strip line secured to the dipole antenna element 7 by, for example, solder 21. The dipole antenna element 7 is spaced from a ground plane 17, preferably of copper, which is also spaced from the feed layer 15 by a layer 19 of any standard dielectric material. The dipole antenna element 7 has a major axis extending in a vertical direction along the length of said dipole antenna element.

It should be understood that, though the antenna array is shown in the shape of a "V" in the preferred embodiment, that shape is not critical. The array can fold back and forth several times, such as in the shape of a "W" or two or more "V"s connected together or any other shape which will provide compactness and, preferably, lower wind resistance.

Though the invention has been described with respect to a specific preferred embodiment thereof, many variations and modifications will immediately become apparent to those skilled in the art. It is therefore the intention that the appended claims be interpreted as broadly as possible in view of the prior art to include all such variations and modifications.

What is claimed is:

1. A ground-based antenna array which comprises:

(a) a housing having an aerodynamically tapered end portion secured from substantial movement relative to the surface of the earth and having a cross section including a pair of spaced apart parallel regions terminating at said tapered end portion;

(b) a first plurality of parallel monopole antenna elements secured to said housing at one of said pair of regions, each antenna element of said first plurality extending in a first direction; and (c) a second plurality of parallel monopole antenna elements secured to said housing at the other of said pair of regions, each antenna elements of said second plurality extending in said first direction, said first plurality being spaced from said second plurality and extending in said first direction.

2. The antenna array of claim 1 wherein said housing is RF transparent in at least a predetermined RF range.

3. The antenna array of claim 1, further including energy feeding means coupled to said antenna elements, a dielectric layer disposed over said energy feeding means and a ground plane disposed over said dielectric layer and spaced from said energy feeding means.

4. The antenna array of claim 2, further including energy feeding means coupled to said antenna elements, a dielectric layer disposed over said energy feeding means and a ground plane disposed over said dielectric layer and spaced from said energy feeding means.

5. The antenna array of claim 1 wherein said tapered portion is substantially "V" shaped, a line substantially bisecting said "V" being substantially normal to said first direction.

6. The antenna array of claim 2 wherein said tapered portion is substantially "V" shaped, a line substantially bisecting said "V" being substantially normal to said first direction.

7. The antenna array of claim 3 wherein said tapered portion is substantially "V" shaped, a line substantially bisecting said "V" being substantially normal to said first direction.

8. The antenna array of claim 4 wherein said tapered portion is substantially "V" shaped, a line substantially bisecting said "V" being substantially normal to said first direction.

9. The antenna array of claim 1 wherein a bisector of said tapered portion is disposed substantially parallel to the surface of the earth at the location of said antenna array and wherein the bottom portion of said tapered portion is pointed to minimize wind resistance.

10. The antenna array of claim 2 wherein a bisector of said tapered portion is disposed substantially parallel to the surface of the earth at the location of said antenna array and wherein the bottom portion of said tapered portion is pointed to minimize wind resistance.

11. The antenna array of claim 3 wherein a bisector of said tapered portion is disposed substantially parallel to the surface of the earth at the location of said antenna array and wherein the bottom portion of said tapered portion is pointed to minimize wind resistance.

12. The antenna array of claim 4 wherein a bisector of said tapered portion is disposed substantially parallel to the surface of the earth at the location of said antenna array and wherein the bottom portion of said tapered portion is pointed to minimize wind resistance.

13. The antenna array of claim 5 wherein a bisector of said "V" is disposed substantially parallel to the surface of the earth at the location of said antenna array and wherein the bottom portion of said "V" is pointed to minimize wind resistance.

14. The antenna array of claim 6 wherein a bisector of said "V" is disposed substantially parallel to the surface of the earth at the location of said antenna array and wherein the bottom portion of said "V" is pointed to minimize wind resistance.

15. The antenna array of claim 7 wherein a bisector of said "V" is disposed substantially parallel to the surface of the earth at the location of said antenna array and wherein the bottom portion of said "V" is pointed to minimize wind resistance.

16. The antenna array of claim 8 wherein a bisector of said "V" is disposed substantially parallel to the surface of the earth at the location of said antenna array and wherein the bottom portion of said "V" is pointed to minimize wind resistance.

* * * * *

UNITED STATES PATENT AND TRADEMARK OFFICE

CERTIFICATE OF CORRECTION

PATENT NO. : 6,111,550

DATED : August 29, 2000

INVENTOR(S) : Darrell W. Miller; Joseph E. Wheeler III; Paul C. Gilliland
Leslie D. Clements It is certified that error appears in the above-identified patent and that said Letters Patent is hereby corrected as shown below:

"Related U.S. Application Data" and "Provisional Application No. 60/026,768 September 26, 1996" should be added to the patent.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*